US008865387B2

(12) United States Patent
Yu et al.

(10) Patent No.: US 8,865,387 B2
(45) Date of Patent: Oct. 21, 2014

(54) ELECTROSTATIC IMAGE DEVELOPING TONER

(75) Inventors: Jae-Goang Yu, Chungbuk (KR); Ho-Geun Jo, Chungbuk (KR)

(73) Assignee: Park & OPC Co., Ltd, Chungbuk (KR)

( * ) Notice: Subject to any disclaimer, the term of this patent is extended or adjusted under 35 U.S.C. 154(b) by 673 days.

(21) Appl. No.: 12/933,160

(22) PCT Filed: Mar. 12, 2009

(86) PCT No.: PCT/KR2009/001232
§ 371 (c)(1),
(2), (4) Date: Sep. 17, 2010

(87) PCT Pub. No.: WO2009/116746
PCT Pub. Date: Sep. 24, 2009

(65) Prior Publication Data

US 2011/0020745 A1 Jan. 27, 2011

(30) Foreign Application Priority Data

Mar. 17, 2008 (KR) ..... 10-2008-0024528

(51) Int. Cl.
*G03G 9/097* (2006.01)
*G03G 9/08* (2006.01)
*G03G 9/087* (2006.01)

(52) U.S. Cl.
CPC ..... *G03G 9/0806* (2013.01); *G03G 9/0815* (2013.01); *G03G 9/08711* (2013.01); *G03G 9/08782* (2013.01); *G03G 9/08797* (2013.01); *G03G 9/08755* (2013.01); *G03G 9/08706* (2013.01); *G03G 9/0817* (2013.01); *G03G 9/08722* (2013.01); *G03G 9/08795* (2013.01)
USPC ..... 430/137.14; 430/106.1; 430/137.1; 430/110.1

(58) Field of Classification Search
USPC ..... 430/137.1–137.15, 106.1, 110.1
See application file for complete search history.

(56) References Cited

U.S. PATENT DOCUMENTS

| | | | | |
|---|---|---|---|---|
| 5,080,994 | A * | 1/1992 | Breton et al. | 430/137.17 |
| 2003/0134220 | A1* | 7/2003 | Emoto et al. | 430/109.4 |
| 2003/0215732 | A1* | 11/2003 | Uchida et al. | 430/110.3 |
| 2007/0009822 | A1* | 1/2007 | Iijima et al. | 430/108.2 |
| 2007/0218381 | A1* | 9/2007 | Uchinokura et al. | 430/108.1 |
| 2008/0063967 | A1* | 3/2008 | Shin et al. | 430/109.3 |
| 2008/0131809 | A1* | 6/2008 | Udo et al. | 430/137.14 |

* cited by examiner

*Primary Examiner* — Mark F Huff
*Assistant Examiner* — Rashid Alam
(74) *Attorney, Agent, or Firm* — Cozen O'Connor

(57) ABSTRACT

The present invention relates to, in the toner including toner particles having a biding agent resin, colorings and a release agent, an electrostatic image developing toner, its composition, and a preparation method thereof. The electrostatic image developing toner is prepared by the method comprising:

(1) preparing an inorganic dispersion medium;
(2) dispersing/dissolving a polymerizable monomer mixture;
(3) micronizing the liquid obtained in step (2) in the liquid obtained in step (1) with high shear force in order to create droplets;
(4) performing radical polymerization of the micronized droplets obtained in step (3);
(5) aggregating particles obtained in step (4);
(6) fusing the aggregate obtained in step (5);
(7) cleaning and drying the toner obtained by step (6); and
(8) adding additives to impart electrification and fluidity to a toner obtained by step (7).

15 Claims, 3 Drawing Sheets

ELECTROSTATIC IMAGE DEVELOPING TONER

RELATED APPLICATIONS

This is a U.S. National Phase Application under 35 USC 371 of International Application PCT/KR2009/001232 filed on 12 Mar. 2009.

This application claims the priority of Korean application no. 10-2008-002458 filed Mar. 17, 2008 the content of which is hereby incorporated by reference.

TECHNICAL FIELD

The present invention relates to, in the toner including toner particles having a biding agent resin, colorings and a release agent, an electrostatic image developing toner, its composition, and a preparation method thereof. The electrostatic image developing toner is prepared by the method comprising:

(1) preparing an inorganic dispersion medium;
(2) dispersing/dissolving a polymerizable monomer mixture;
(3) micronizing the liquid obtained in step (2) in the liquid obtained in step (1) with high shear force in order to create droplets;
(4) performing radical polymerization of the micronized droplets obtained in step (3);
(5) aggregating particles obtained in step (4);
(6) fusing the aggregate obtained in step (5);
(7) cleaning and drying the toner obtained by step (6); and
(8) adding additives to impart electrification and fluidity to a toner obtained by step (7).

The toner according to the present invention has a narrow gain size distribution, has small consumption and imagery stability.

Also, the present invention relates to an electrostatic image developing toner composition wherein a grain diameter (D50 (A)) of the first suspension toner particles in micron which is made as the desired toner droplets particles by suspending the polymerizable monomer mixed liquid of water-borne media and a grain diameter (D50(B)) of the final toner particles which is made by a polymerizing, aggregating to a desired size of the particles, fusing, cleaning and drying meet the following equation 1:

[EQUATION 1]

$$0.2 \leq A/B \leq 0.5 \quad (1)$$

$$4\ \mu m \leq B \leq 10\ \mu m \quad (2)$$

wherein,

A: a grain diameter (D50(A)) of the first suspension toner particles in micron

B: a grain diameter (D50(B)) of the final toner particles after aggregation

BACKGROUND ART

Mostly, the use of an image development machine such as an electro photography copy machine and printer is expanded, particularly digital image scan devices are generally propagated and documents having high quality images and excellent expressiveness are needed, also faultlessness and, moreover, a high quality of printed images are required by supplying and growth of presentation software.

Prior various electro photographic methods are disclosed at U.S. Pat. No. 2,297,691, and Japanese Patent 1968-23910 (U.S. Pat. No. 3,666,363) and so on.

Generally, a copy image or a printed image may be obtained by forming an electrostatic latent image on a photosensitive member by various means using photoconductive materials, developing the latent image using a toner and transferring the toner image to a transfer medium such as a paper as occasion demands, and fixing thereof by action of heat, pressure, heat and pressure, or solvent steam. Also, the abovementioned processes are repeated after cleaning the toner left on the photosensitive member without transfer using various means.

Various methods such as the method for developing an electrostatic image using a toner or the method for fixing a toner image are conventionally provided. The toner used for these purposes is generally a grinding toner made as a toner having a desired grain diameter obtained by fusing and mixing colorings consist of a dye or a pigment of thermoplastics and uniformly dispersing thereof, and grinding finely and sorting thereof.

However, while the toner made by the abovementioned method has a good quality, it has some problems in view of imagery quality. For example, the resin composition in which the colorings are dispersed is easily breakable enough to be finely grinded by an economical manufacturing device. However, the resin composition is easy to form particles having a wide grain diameter substantially in fine grinding rapidly, particularly may cause a seriously problem such as document pollution because there are relatively small particles thereof. In this context, while a sorting process is performed in order to remove undesired particles, there is, in this case, a critical problem that it causes high production costs that production yield in manufacturing is low because of wide grain size distribution.

Meanwhile, to solve the problem of the toner made by the grinding methods, Japanese Patent 1962-10231, 1968-10231, 1978-14895 provide the methods for product a toner by suspension polymerization. In the suspension polymerization method, toner particles having a desired grain diameter are obtained by forming monomer composition by uniformly dissolving and dispersing polymerizable monomer, colorings, polymerization starter, if required, cross-linker, charge control agents, and other addition agents, dispersing the monomer composition to aqueous-phase medium including dispersion stabilizer. The method has some advantages that it needs not the breakable property of the resin composition because of having not the grinding step, and can use soft materials, and also that the toner particles has uniform frictional electrification because the colorings does not expose to the surface of the toner particles. Also, the method is very effective in the view of cost reduction such as energy save, production time shortening, process yield improvement, etc. because the sorting step can be omitted.

However, if the grain diameter of the toner is more finer even in the case of using the method, the colorings come easily out the surface of the toner particles so that the performance of the toner will be negatively influenced. Consequently, the method has a disadvantage that the uniform electrification may be degraded and the development capability of the toner may be changed.

The phenomenon is noticeable in case of copy or printing particularly in environment of high temperature and humidity. In relation to that, the method for spreading a resin on the surface layer of the toner particles such as described in Japanese Patent 1988-73277, 1992-35662 is suggested. Though the method may prevent the abovementioned phenomenon affected by colorings by making the thick of the spread layer be thicker, it has a serious problem that absolute value of the quantity of electron charge become smaller because the toner contains little composition having charge controllability. Such problem is being recognized and reported substantially in many case.

To solve the problem, the method for adhering charge control agents to the surface of the toner such as described in Japanese Patent 1990-62666, 1990-273558, and 1994-134437 is suggested. However, the method may cause a serious problem in operation as, in case of repeat of copy or printing, the charge control agents are separated from the surface of the toner particles in view of durability of the toner.

Meanwhile, Japanese Patent 1986-238846, and 1994-197203 disclose the use of an electrostatic image developing toner containing the toner particles made by suspension polymerization method which performs dispersing polymerizable monomer composition containing polyester resin to water-borne medium and assembling thereof. However, it is expected to provide an electrostatic image developing toner having a better friction electrification, multiple operation, heat-resisting offset property and translucency.

DISCLOSURE OF INVENTION

Technical Purpose of the Invention

Improvement of low temperature fixing property is an important factor for performing high speed processing and full color printing by a printer and a copy machine. In this respect, it is preferable a toner obtained by a polymerization method wherein obtainment of toner particles of which the grain diameter has a sharp distribution and is very small may be relatively easy. It is essential that the toner used in a full color copy machine or a full color printer endures well a compound color in fixing step, thus, improvement of color reproduction or maintenance of transparency of OHP image is very important. Also, it is preferable that the color toner is made with the resin having better fusing property and lower molecular weight than a black-and-white toner.

Wax having relatively high degree of crystallization, for example, polyethylene wax and polypropylene wax are used as release agents of the black-and-white toner in order to improve heat-resisting offset property in fixing. However, in the case of the full color toner, because of high degree crystallization of the wax, transparency of image lowers in printing through OHP and serious problems occurs in high speed processing and low temperature fixing property.

Therefore, generally wax having a low degree of crystallization and a low melting point should be added in order to improve the low temperature fixing property.

Thus, for a toner, particularly a color toner made by a polymerization method, it is required to provide a toner which is solvable smoothly the problems occurred all in development and fixing property.

Technical Solution

The object of the present invention is to provide an electrostatic image developing toner which solves the abovementioned problems, a composition of the toner and a preparation method of the composition. The present invention relates to the electrostatic image developing toner which is prepared by the following method, and the preparation method comprising:

(1) preparing an inorganic dispersion medium;
(2) dispersing/dissolving a polymerizable monomer mixture;
(3) micronizing the liquid obtained in step (2) in the liquid obtained in step (1) with high shear force in order to create droplets;
(4) performing radical polymerization of the micronized droplets obtained in step (3);
(5) aggregating particles obtained in step (4);
(6) fusing the aggregate obtained in step (5);
(7) cleaning and drying the toner obtained by step (6); and
(8) adding additives to impart electrification and fluidity to a toner obtained by step (7).

Also, the another object of the present invention is to provide an electrostatic image developing toner composition wherein a grain diameter (D50(A)) of the first suspension toner particles in micron which is made as the desired toner droplets particles by suspending the polymerizable monomer mixed liquid of water-borne media and a grain diameter (D50 (B)) of the final toner particles which is made by a polymerizing, aggregating to a desired size of the particles, fusing, cleaning and drying meet the following equation 1:

[EQUATION 1]

$$0.2 \leq A/B \leq 0.5 \quad (1)$$

$$4\ \mu m \leq B \leq 10\ \mu m \quad (2)$$

wherein,

A: a grain diameter (D50(A)) of the first suspension toner particles in micron

B: a grain diameter (D50(B)) of the final toner particles after aggregation

The other object of the present invention is to provide an electrostatic image developing toner composition having a narrow gain size distribution and a good low temperature fixing property, and a preparation method thereof.

The colorings used in the present invention are preferably selected of known pigments which may be used in the toner and are used.

For example, there are black pigment, yellow pigment, magenta pigment, cyan pigment as the pigments, and there are carbon black, aniline black, nonmagnetic ferrite, and magnetite etc, as the black pigment.

The carbon black for black pigment exists as an aggregate of very fine first particle, and is easy to be coarsened because of re-aggregation in being dispersed as pigment dispersion agent. A degree of re-aggregation of the carbon black particles has relevance to a large/small quantity of impurities contained in the carbon black, therefore it is very preferable that the quantity of impurities is contained to the extent that the polymerization is not prevented. In the present invention, it is preferable that the carbon black is made by Furnace method.

A compound which represents Nitrogenous fused compound, Isoindolinone compound, Azo metal complex compound, Arylamine compound, etc. is used as the yellow pigments. Concretely, C.I. Pigment Yellow 12, 13, 14, 15, 17, 62, 74, 83, 94, 95, 109, 110, 111, 128, 147, 150, 155, 168, 180, 194, etc. are used, and it is able even to use only one or mixedly more than one of the Yellow Pigments for color mixture.

Nitrogenous fused compound, Pyrrole compound, Anthraquinone, Quinacridone compound, Naphthol compound, Benzoimidazolone compound, Thio indigo compound, Perylene compound are used as the magenta pigment. Concretely, C.I. Pigment Red 2, 3, 5, 6, 7, 12, 48:2, 48:3, 48:5, 68:1, 81:1, 122, 144, 166, 169, 173, 184, 185, 202, 206, 207, 209, 220, 221, 238, 254, C.I. Violet 19 etc. are preferable. Among them, Quinacridoneseries Pigment represented by C.I. Pigment Red 122, 202, 207, 209, C.I. Pigment Violet 19 is more preferable. C.I. Pigment Red 122 of the Quinacridoneseries Pigment is very preferable.

Copper phthalocyanine compound and its derivatives, Anthraquinone compound etc. may be used as the cyan pigment. Concretely, C.I. Pigment Blue 1, 15, 15:1, 15:2, 15:3, 15:4, 60, 62, 66 etc. and C.I. Pigment Green 7, 36 etc. may be used particularly.

Such colorings may be used alone, in a mixture or in a solid solution. The colorings are suitably selected considering color, a degree of color saturation, brightness, weathering, OHP transparency, and dispersion property in the toner particles.

The colorings may be added by 1 to 20 weight based on 100 weight of a bonding agent.

In the present invention, the toner particles should be used with attention of a unique polymerizing restrain action or an aqueous phases transfer property contained in the colorings because it is made by polymerization method. Surface of the colorings may be modified by hydrophobic treatment using materials without polymerization retrainable property. Particularly, the carbon black has polymerization retrainable property, thus it should be careful to use it.

In the method for manufacturing toner particles, it is preferable to add a polymer or copolymer having polar group (hereafter referred as polar resins) and polymerize thereof, add a polar monomer and polymerize thereof, or mixed-add the polar resins and the polar monomer and polymerize thereof before manufacturing first suspension toner particles in state of fine particles.

The polymer and copolymer having polar group which may be used in the present invention are followed.

For example, it is nitrogen-containing polymer such as ethyl of methacrylic dimethyl acid network, ethyl of metacrylic acid diethyl network, etc. or copolymer with styrene-unsaturated carbonic acid ester, etc. or nitrile-based monomer such as acrylonitrile, halogen-containing based monomer such as vinyl chloride, unsaturated carbonic acid such as acrylic acid or methacrylic acid etc. or a polymer such as unsaturated diacid, unsaturated diacid anhydride, nitrogen-containing monomer, etc. or copolymer with styrene-based monomer, etc. or polyester resins, or epoxy resins. Among them, the polyester resins are very preferable.

In the present invention, acid number of the polymer or copolymer having polar group is value measured according to JISK-0070 Method. It is preferable that the acid number is 3 to 50 mg/KOH/g, more preferable that it is 5 to 30 mg/KOH/g.

Also, monomers having polar group which may be used in the present invention are followed.

The monomers having polar group are divided into acidic monomer and basic monomer. The acidic monomer is a polymerizable monomer having carboxyl group such as acrylic acid, methacrylic acid, itconic acid, maleic acid, fumaric acid, cinnamic acid, etc. or a polymerizable monomer having sulfonic acid group such as sulfonated styrene, etc. or a polymerizable monomer having sulfonamide group such as vinyl benzene sulfonamide, etc. also, the basic monomer is a nitrogen-containing heterocyclic polymerizable monomer such as aromatic vinyl compounds, vinyl pyridine, vinyl pyrrolidone etc. which have amino group such as styrene network.

Such polar monomer may be used alone, or used in mixture. Also, it is possible that the polar monomer exists as salts with counter-ions. Among them, it is preferable to use the acidic monomer, more preferable to use acrylic acid or methacrylic acid.

It is preferable that a ratio of an amount of the polar resins or the polar monomer or the mixture of the polar resins and the polar monomer in total amount of 100% by weight of polymerizable monomer consisting of binder resins as first suspension toner particles in state of fine particles is an amount of 0.05% by weight to 20% by weight, more preferable 0.5% to 15% by weight. In the case of the rage of the ratio, the first suspension toner particles in the state of fine particles to be gotten have improved stability is easy for a shape or a grain diameter of the particles to be controlled. However, in the case of less than 0.05% by weight of the ratio, the polymerizable monomer exists as a mixed layer, thus it is easy for assembly and polymerization stability to be deteriorated, also it causes the hardness of the generated resins particles surface layer to lower and properties of charge stability, durability, conservativeness, etc. as a toner to lower. Also, in the case that exceed than 20% by weight of the ratio, viscosity of the generated polymerizable monomer is too increased, therefore it is difficult to control the grain diameter of the desired assembling particles, and also cause the gained toner not to fuse and fixing property to damage seriously.

Polymerizable monomers having polar group which may be used in the present invention are followed. For example, there are styrene monomers such as styrene, chlorostyrene, dichlorostyrene, p-tert-butyl styrene, p-n-butyl styrene etc., acrylic acid ester monomers such as acrylic acid methyl, acrylic acid ethyl, acrylic acid propyl, acrylic acid n-butyl, acrylic acid iso butyl, acrylic acid hydrixy ethyl, acrylic acid ethylhexyl, etc., methacrylic acid ester monomers such as methacrylic acid methyl, methacrylic acid ethyl, methacrylic acid propyl, methacrylic acid n-butyl, methacrylic acid iso butyl, methacrylic acid hydroxylethyl, methacrylic acid ethylhexyl etc., acrylamid monomers such as acrylamid N-propyl, acrylamid N,N-dimethyl, acrylamid N,N-dipropyl, acrylamid N,N-dibutyl, etc., monomers such as acrylo nitryl, methacrylonitryl etc. While such polymerizable monomers are used alone or in mixture, it is preferable to use a styrene monomer or the styrene monomer with one monomer or more than one monomer selected of acrylic acid ester monomers and methacrylic acid ester monomers in order to obtain good toner particles in a view of developing property and durability etc, in developing.

Also, the polymerizable monomers are generally used alone or appropriately with mixture for theoretical Glass Transition Temperature (Tg) to be 40~75° C. which is disclosed at Polymer Handbook second edition III pp. 139~192 (Jone Wiley & sons private). In the case of less than 40° C. of the theoretical Glass Transition Temperature (Tg), it is easy to encounter some problems related to preserving stability and durable stability of the toner, and in the case of exceeding 75° C., fixing point of the toner become climb. Particularly, in the case of a color toner in order to form full color image, it is not preferable because, in fixing, mixing color property is declined, color reproducibility is feeble, and also transparency of OHP image is lower.

In the method for manufacturing toner particles according to the present invention, it is one preferable type to contain release agents in toner particles. Toner image transferred on transfer material is fixed on the transfer material by energy such as heat or pressure, etc., and therefore a semi-permanent image is obtained. At this time, it is general to use a heat-roll fixing method. While it may obtain very high definitional image using toner particles having small grain diameter, in the case of using transfer material such as paper, it is easy to encounter low temperature offset because the toner particles having small grain diameter does not take enough heat from the heat fixing roller due to the particles' getting into fiber of the paper.

However, related to the problem in the present invention, it may manufacture toner particles having high resolution and anti-offset property and also suitable to image forming device by using proper quantity of wax as a release agent.

Usable wax as a release agent used in the present invention is petroleum-based wax and its derivatives such as paraffin wax or styrene modified paraffin wax, micro crystal wax, petrolatum, montan-based wax and its derivatives, hydrocarbon wax and its derivatives by Fischer-Tropsch method, polyolefin wax and its derivatives represented by polyethylene, and natural wax and its derivatives such as carnauba wax, candelila wax, etc., and the derivatives contain block copolymer with oxide or vinyl-based monomer, and modified graft monomer. Also, fatty acids or compounds thereof such as higher aliphatic alcohol, stearate, palmitic acid, etc., acid amides wax, ester wax, plant-based wax, animal-based wax, etc. may be used.

In a curve measured by DSC (Differential Scanning Calorimetry), it is preferable that such wax component has a maximum heat absorption peak at 40° C. to 110° C. in heat up. It has a big efficiency of low temperature deposition and also shows an effective releasing property to have the maximum heat absorption peak in the temperature range. It is not preferable because the fixing temperature is climbing and low temperature is generated to exceed 110° C. of the maximum heat absorption peak. For example, DSC 200F3 of NETZSCH is used for measuring the maximum heat absorption peak of the wax component. Fusing point of indium and zinc is used for temperature correction of a detection part of the device, and the heat of fusion of indium is used for calorie correction. Sample for the measurement is aluminum cell, and the measurement is performed at 10° C./minute of heat up rate.

It is preferable that a content of the wax component is an amount of 0.1 to 30% by weight, more preferable 0.5% to 20% by weight. Being less than 0.1% by weight of the content, it causes a releasing property to lower, so enough low temperature offset retrain effect is not shown. In case of exceeding 30% by weight, dispersion property of other material is deteriorated, or an aggravation of toner fluidity or a falling-off in image property is caused.

In the present invention, charge control agent may be used in order to stabilize charge property of toner particles. What is known as the charge control agent may be used, particularly it is preferable to use a charge control agent which may have a rapid charging rate and keep stably uniform charging quantity. Also, it is preferable that the charge control agent has a low polymerizable inhibitory and has not any solubilized material to water-borne dispersion medium. Concretely, in the charge control agent, metal compounds of aromatic series carboxylic acids such as salicylic acid, alkyl salicylic acid, dialkyl salicylic acid, naphthoeic acid, dicarboxylic acid, metallic salt or metal complex of azo dye or azo pigment, polymer compound having sulfonic acid or carboxyl acid in a branch, boron compounds, urea compounds, silicon compounds, carixareum, etc. are used as negative charge control agents, and nigrosine-based compounds, quaternary ammonium salts, polymer compounds having the quaternary ammonium salts in a branch, guanidine compounds, imidazole compounds, etc. are used as positive charge control agents.

It is preferable to use the charge control agent with 0.5 to 10 part by weight for 100 part by weight of polymerizable monomer. However, in the present invention, it is not essential to use charge control agent. Thus, in the developing device of the image forming machine, charging quantity or charging rate may be controlled by using actively absence of restriction of layer pressure of the toner or frictional charging with developer bearing body (the abovementioned rotational sleeve). In the case of adding the charge control agent, it is preferable to determine its quantity to be added in view of using type of toner particles to be obtained.

In the present invention, it is possible to use with a known inorganic dispersion agent as dispersion stabilizer. It is difficult for the inorganic dispersion agent to generate a harmful ultra fine powder. Also, it obtains dispersion stability due to its sterical hinderance property. Thus, changing a reaction temperature, it is not easy to loss the stability. Also, it is possible to be used preferably because it is easy to be cleaned and it is difficult to have a bad influence to toner particles.

Magnesium phosphate, magnesium hydrogen phosphate, magnesium dihydrogen phosphate, aluminum phosphate, zinc phosphate, tricalcium phosphate, calcium hydrogen phosphate, calcium dihydrogen phosphate, hydroxyapatite, etc. and a mixture thereof are used properly in micron state as specific compounds of such inorganic dispersion agent. Calcium phosphate salts containing phosphate and calcium is preferable.

Also, considering to crystal size of such salts, grain diameter of crystal agglomerates, a solubility to acids, etc., the mixture of the abovementioned compounds containing hydroxyapatite and calcium phosphate is preferable. Also, the hydroxyapatite or the mixture of hydroxyapatite with calcium phosphate is more preferable.

It is preferable to use the inorganic dispersion agent, alone or with mixing more than one, with 0.2 to 20 part by weight for 100 part by weight of polymerizable monomer composition. Being quantity of the inorganic dispersion agent less than 0.2% by weight, the effect by addition is not obtained enough. In the case of exceeding 20% by weight, the abovementioned dispersion stabilizer can be interfered and it can have a bad effect to the dispersion of polymerizable monomer composition.

For producing toner particles, the toner particles may be produced by using polymerization reation.

For example, there are suspension polymerization method, emulsion polymerization method, emulsion associative polymerization method, dispersion polymerization method, suspension aggregation polymerization method, etc. In the present invention, suspension aggregation polymerization method which performs suspension polymerization in minute particles state, aggregates the particles into a desired size, and fusing thereof by heat in view of proper spheronization and ease of control of grain size.

In the method for manufacturing toner particles of the present invention, it is preferable to generate first suspension toner particles in minute particles state, aggregate thereof into a desired size, and fuse thereof by heat. In the method for producing the first suspension toner particles in minute particles state, toner particles of which grain size distribution of desired shape is very uniform may be obtained by containing sparingly water-soluble metallic salt colloid as the dispersion stabilizer, dispersing at least polymerizable monomer, polar resins, colorings, wax, etc. of water-borne dispersion medium, generating droplet particles of polymerizable monomer composition, adding polymerization starter into mixtures and adding thereof to the droplet particles before polymerization, polymerizing polymerizable monomer components, aggregating first suspension toner particles in polymerized minute particle state into a desired size using an aggregation agent, and fusing thereof by heat. The method is shown through FIG. 2 and FIG. 3. Meanwhile, because surface and shape of obtained toner particles are uniform, charging property thereof is uniform. Also, in the electric photo process, good developing property is represented in electrostatic latent image developing.

In the method for producing the first suspension toner particles in micron state of the present invention, polymerizable monomer mixture which is solved uniformly or dispersed using a homogenizer such as homogenizer, ball mill, colloid mill, ultrasonic homogenizer, etc. is suspended in the water-borne medium. At this time, using high speed homogenizer such as high speed blender or ultrasonic homogenizer, the polymerizable monomer mixture is stabilized by keeping the water borne minute particle in droplet state in order to disperse uniformly the polymerizable monomer mixture in the water-borne dispersion medium.

However, in the present invention, it is not essential to use charge control agent. Thus, in the developing device of the image forming machine, charging quantity or charging rate may be controlled by using actively absence of restriction of layer pressure of the toner or frictional charging with developer bearing body (the abovementioned rotational sleeve). In the case of adding the charge control agent, it is preferable to determine its quantity to be added in view of using type of toner particles to be obtained.

First polymerizable monomer droplets in stabilized minute particle state are polymerized with a polymerization starter. At this time, while the temperature of polymerization is determined according to properties of matter of the polymerization starter, particularly a half-life temperature, the temperature is set at more than 40° C., generally 50 to 90° C. and the polymerization is started.

It is preferable to use a water-soluble starter and an oil-soluble starter as the polymerization starter, wherein the half-life of the oil-soluble starter is 0.5 to 30 hours in polymerization reaction. For example, persulfates such as peroxide, potassium persulfate, etc., organic peroxides such as benzoylperoxide, auryl peroxide, etc., azo-group compounds such as 2,2'-azobis isobuthyronitrile, 2,2'-azobis(2,4-dimethylvaleronitile), etc., redox-group starter, etc. are used. Particularly, azo-group compounds or organic peroxides are preferable. In such polymerization starter, it is possible to obtain a polymer having a maximum in the range of weight average molecular weight 10,000 to 300,000 using quantity of 0.1 to 20 part by weight of alone or more than one of polymerization starter for 100 part by weight of polymerizable monomer, and to give preferable strength and proper fusing property to toner particles. Departing the half-life and addition quantity of the polymerization starter from the range, polymerizable monomers are not polymerized enough, or a good property of matter of the polymerized binding resins may have damage.

The abovementioned polymerization starter may be added to the polymer whenever before adding the polymerizable monomer, simultaneously adding it, or after adding it, and such adding methods are performed with combined as demanded.

Also, in the present invention, a cross-linker may be added, and preferable adding quantity thereof is 0.001 to 15% by weight for 100 part by weight of polymerizable monomer. Generally two more polymerizable compounds having a double band are used as the cross-linker. For example, aromatic series divinyl compound such as divinylbenzen, divinylnaphthalene, etc., carboxylic acid ester having two double bands such as ethyleneglycole, diacrylate, ethyleneglycoledimethacrylate, 1,3-buthandioldimethacrylate, etc., compounds having three more vinyl groups such as divinyl aniline, divinyl ester, divinyl sulfide, divinyl sulfone, and divinyl compounds are used alone or with mixed. The adding quantity of the cross-linker being less than the range, it does not work enough. However, exceeding the range, the property of matter of binding resins may have bad influence.

Also, polymerization time being determined in view of polymerization conversion ratio, it is preferable that it is more 30 minutes, generally 1 hour to 20 hours.

In the present invention, it is preferable that the grain diameter (D50) of first suspension toner particles in micron state and the grain diameter (D50) of final toner particles after aggregation are in the following 1:

[EQUATION 1]

$$0.2 \leq A/B \leq 0.5 \quad (1)$$

$$4\ \mu m \leq B \leq 10\ \mu m \quad (2)$$

wherein,

A: a grain diameter (D50) of the first suspension toner particles in micron state.

B: a grain diameter (D50) of the final toner particles after aggregation.

In the case that A/B which is the ratio of a grain diameter (D50) of the first suspension toner particles in micron state to the grain diameter (D50) of the final toner particles after aggregation is less than 0.2, there are some difficulties that much aggregation agents are needed, production of toner particles is difficult in the first suspension polymerization, and also much fine particles may be contained. Meanwhile, in the case that the ratio exceeds 0.5, there is a problem that the size of the final toner particles after aggregation is too coarse so that the particles are scattered and a resolution is lowered in electrophotographic process, thereby final image has a bad influence.

The first suspension toner particles in micron state generated by the polymerization are gone through aggregation process using a proper aggregation agent to have a desired grain diameter.

Aggregation process in producing general oil-soluble polymerization toner particles is difficult to be aggregated uniformly because aggregation rates of components contained in each dispersed liquids are different when the different kinds of dispersed liquids are mixed and aggregated in aggregation. Also, aggregation speeds thereof are different according to adding condition and time and it has many times. Thus, many processes should be supplemented.

However, the present inventors can make the aggregation process simpler and simultaneously produce easily the desired toner particles uniformly by making uniform toner particles from the first minute particles, and aggregating thereof.

An aggregation treatment used in the aggregation process is generally a method for heating in a blender, a method for adding an electrolyte, and a method combined thereof, etc.

In the case of the method for adding an electrolyte of the aggregation treatments, it is preferable that the electrolyte is any one of organic material or inorganic material. Concretely, it is an inorganic salts having monovalent metallic cations such as NaCl, KCl, LiCl, $Na_2SO_4$, $K_2SO_4$, $Li_2SO_4$, $CH_3COONa$, $C_6H_5SO_3Na$, etc., an inorganic salts having divalent metallic cations such as $MgCl_2$, $CaCl_2$, $MgSO_4$, $CaSO_4$, $ZnSO_4$, etc., an inorganic salts having trivalent metallic cations such as $Al_2(SO_4)_3$, $Fe_2(SO_4)_3$, etc. It is preferable to use inorganic salts having multivalent metallic cations in view of a high speed and high yield. Also, it is preferable to use the inorganic salts having monovalent metallic cations in view of controlling the speed of aggregation growth. What is used as the electrolyte may control an aggregation property by using one selected of inorganic salts having monovalent, divalent, trivalent metallic cations or with mixed thereof.

Particularly, it is very preferable to select properly one of inorganic salts having divalent or trivalent metallic cations so that the aggregation property of the particles has a high speed, and then to select inorganic salts having monovalent metallic cations so as to control the aggregation speed.

Also, it is preferable to adding the electrolytes not at the same time but slowly in intermittent or continuous method. While the adding time is different according to a kind of the electrolytes and quantity to be used thereof, it is preferable for addition to be carried out during one more minutes. Generally, the electrolytes being put at the same time, it is difficult to control the aggregation of the particles because the aggregation starts suddenly. Also, a desired toner particles and grain diameter distribution cannot be obtained because there remain many first toner particles in micron state or too many aggregates.

Also, in the case of carrying out the aggregation with adding the electrolytes, it is preferable that temperature of the aggregation process is 0° C. to 90° C., more preferably 5° C. to 80° C. To control the temperature of the aggregation process is one method for control the grain diameter and shape of special range of the present invention. It is possible for the aggregation process to be carried out by controlling pH or by adding polar organic solution such as alcohol.

In the present invention, it is preferable that fusing process temperature by heat is preferably more than glass transfer temperature (Tg) of first suspension toner particles in micron state, more preferable is more Tg+5° C. and less than Tg+50° C. Also, while time needed in the fusing process is different according to the shape of toner, it is preferable that it is generally 0.1 to 20 hours after arriving at more glass transfer temperature of first suspension toner particles in micron state. It is more preferable to be kept during 0.5 to 15 hours.

As such, first suspension toner aggregates in micron state are fused and integrated by heat. While particle aggregates before fusing process are aggregate by electrostatic or physical aggregation, various types of toner such as the shape for first suspension toner particles in micron state to be aggregated, for example, a potato type or sphere type may be obtained by controlling temperature and time, etc. of fusing process through the fusing process.

The toner aggregate gone through each abovementioned processes is sorted into solid/liquid according to a known method, and a desired toner particles may be obtained by collecting the particle aggregate, cleaning and drying thereof as demanded.

Surface of the desired toner particles obtained by the abovementioned processes is mixed to with a known additive in order to control fluidity or developing property. The additive is metal oxide such as alumina, silica, titanium dioxide, zinc oxide, zirconium oxide, cesium oxide, talcum, hydrotalcite, etc., metal titanate such as hydroxide, calcium titanate, strontium titanate, barium titanate, etc., nitride such as titanium nitride, silicon nitride, etc., acrylic carbide based resins such as titanium carbide, silicon carbide, etc., organic particles such as melamine resins, and the mixture thereof. Silica, titanium dioxide, alumina among them is preferable. Also, for example, the surface is more preferable to be treated by silane coupling agent or silicon oil, and so on. It is preferable that average first grain diameter is in range of 500 nm, more preferable 5 to 100 nm. Also, in the range, an additive having the small grain diameter and an additive having the large grain diameter are preferable to be used together.

Total mixed quantity of the additive is preferable to be in range of 0.05 to 10 part by weight for 100 part by weight of the toner particles, more preferable 0.1 to 5 part by weight.

The toner of the present invention obtained by the abovementioned methods is for distribution of charging quantity to be sharp in comparison to prior toner. The distribution of charging quantity is related to grain diameter of toner and position of charge control agent. Thus, in the case of wide distribution of the grain diameter as prior toner, charging quantity became wide. Thereby, the wide distribution of charging quantity makes it difficult to control with a desired developing condition, makes the ratio of low charging particles of high charging particles increase, and thus results in various image faults.

Effects of the Invention

The present invention is easy to control grain diameter and rounded image by preparing first suspension toner in micron state, carrying out first aggregation with a aggregation agent, and then fusing thereof. Also, the present invention has more simple producing processes in comparison to prior toner producing processes and provides an electrostatic image developing toner having uniform distribution of grain size, thus is useful to an electro photographic process requiring high resolution and a low temperature fixing property.

DESCRIPTION OF SPECIFIC EMBODIMENTS

Figure 1:
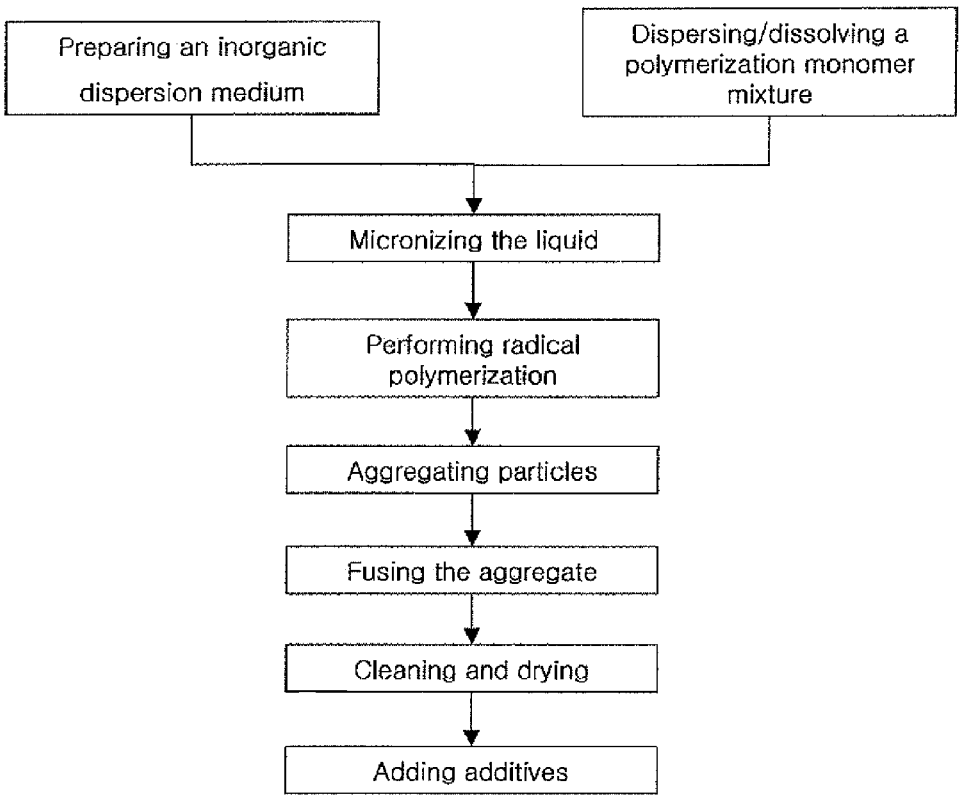
FIG. 1 shows preparing process according to embodiment of the present invention.

Now, various embodiments of the present invention will be specifically described. However, the embodiments not are intended to limit the scope of the present invention.

In the following examples, "part" is represented as "part by weight".

Embodiment 1

Inorganic Dispersion Medium Preparing Process

| | |
|---|---|
| Ion-exchanged water | 900 part |
| $Na_3PO_4$ | 6.7 part |
| $CaCl_2$ | 7.6 part |

In the condition of heating the abovementioned components to 60° C., aqueous dispersion medium containing hydroxyapatite (generation theoretical quantity: 7.1 part by weight) which is insoluble minute particular dispersion stabilizer is obtained by stirring the abovementioned components with 10,000 RPM using TK type homomixer Mark III (made by Primix).

Polymerizable Monomer Mixture Dispersion and Solution Process

| | |
|---|---|
| Styrene | 80 part |
| n-buthyl acrylate | 20 part |
| Paraffin wax (fusing point 72° C.) | 10 part |
| Carbon black (first grain diameter 31 nm) | 5 part |
| Polar resins (Polyester resins, ET-2900, made by SK Chemical) | 5 part |
| Methacrylic acid | 1 part |
| Cross-linker (divinylbenzen, made by Aldrich) | 0.5 part |
| di-tert-buthyl salicylic acid zinc compound (E-84, made by Orientchemical) | 1 part |

After dispersing the abovementioned components during 5 hours using Attritor (PE-075, made by Netzsch), a polymerizable monomer compounds is prepared by heating thereof at 60° C. A polymerizable monomer compounds is prepared by solving 4 part of 2,2'-azobis(2,4-dimethylvaleronitril) as a polymerization starter in the styrene with maintaining 60° C., and then adding thereof to the polymerizable monomer compounds.

Droplet Preparing Process

A polymerizable monomer mixture in dripped state is prepared by putting the abovementioned polymerizable monomer compounds into the inorganic dispersion medium solution under nitrogen gas flow, and stirring thereof with 10,000 RPM during 10 minutes at 60° C. using TK type homomixer Mark II (made by Primix).

Polymerization Process

First suspension toner particles in micron state is prepared by stirring the polymerizable monomer mixture in dripped state not to sink or float after changing into Teflon stirring blade, and simultaneously carrying out polymerization during 5 hours at 70° C.

From the result of measuring the prepared first toner particles in micron state, average grain diameter (D50) is 2.2 μm, and a degree of rounding is 0.975.

Aggregation Process

After maintaining the prepared first suspension toner particles in micron state at 60° C., the aggregation process carried out by adding 5 part of aluminum sulfate solution of 0.5% by weight into thereof slowly through 5 minutes until average grain diameter (D50) of final toner particles reaches to 7.0 μm.

Fusing Process

After the aggregation process, the prepared first toner particles in micron state are heated at 80° C. through 1 hour. Then, with maintaining the temperature at 80° C., stirring carries out with 150 RPM during 3 hours.

Cleaning and Drying Process

Decompression filtering carried out by cooling slurry obtained after the abovementioned fusing process, adding 5N hydrochloric acid for pH to maintain below 2, thereby for the inorganic dispersion medium to be solved.

Then, after enough cleaning thereof many times using ion exchanged water 500 part, toner particles 1, wherein average grain diameter (D50) is 7.8 μm, and the degree of rounding is 0.978, are obtained by drying thereof at 45° C. decompression dryer during 24 hours.

Figure 2:
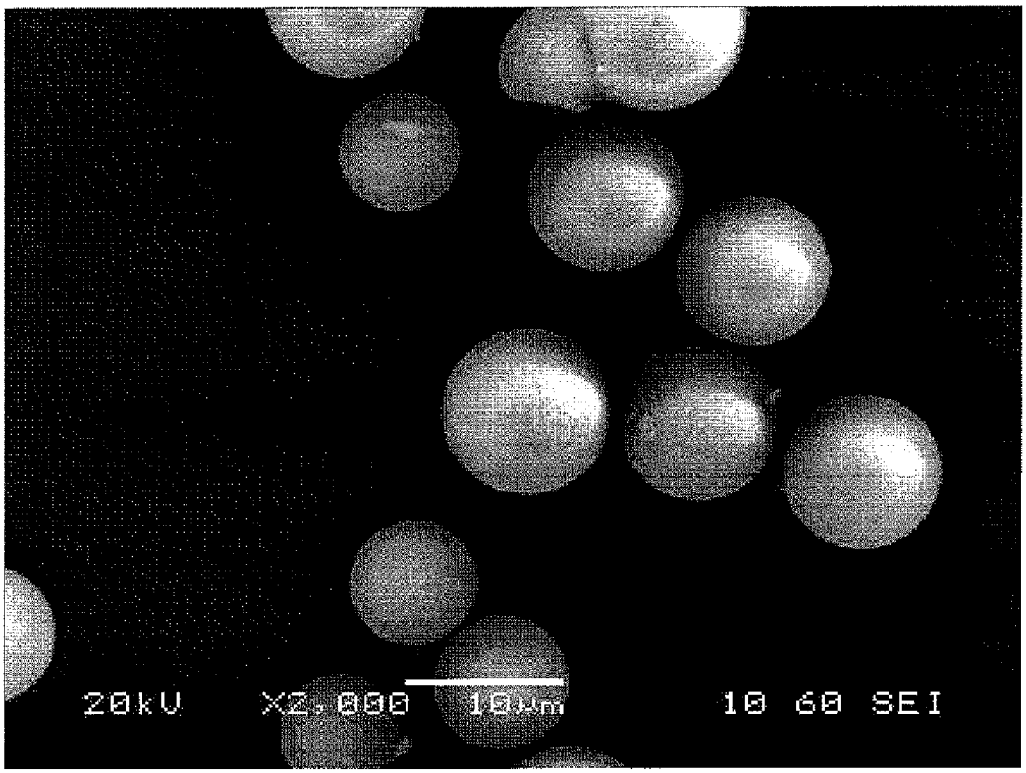
FIG. 2 shows SEM (Scanning Electron Microscope) photography of toner particles prepared by the embodiment 1 of the present invention.

Photography that the obtained toner particles are observed by Scanning Electron Microscope (SEM, made by Jeol) is shown in FIG. 2.

Addition Process

Black toner 1 having good fluidity is obtained by mixing hydrophobic silica (R972, made by Degu) 1 part with 100 part of the toner particles 1 using multipurpose small mixing grinder (made by Mitsui mine).

The result of measuring black toner 1 is shown in [table 3].

Embodiment 2

In the inorganic dispersion medium preparing process, the polymerizable monomer mixture dispersion and solution process, the droplet preparing process, the polymerization process, the aggregation process, the fusing process, the cleaning and drying process, and the addition process of the embodiment 1, black toner 2 is prepared as the embodiment 1 except the inorganic dispersion medium preparing process, the droplet preparing process, the addition process modified as the following.

Inorganic Dispersion Medium Preparing Process

| | |
|---|---|
| Ion-exchanged water | 900 part |
| $Na_3PO_4$ | 13.4 part |
| $CaCl_2$ | 15.2 part |

In the condition of heating the abovementioned components to 60° C. in a 2 L flask, aqueous dispersion medium containing hydroxyapatite (generation theoretical quantity: 14.2 part by weight) which is insoluble minute particular dispersion stabilizer is obtained by stirring the abovementioned components with 10,000 RPM using TK type homomixer (Mark II, made by Primix).

Droplet Preparing Process

A polymerizable monomer mixture in dripped state is prepared by putting the abovementioned polymerizable monomer compounds into the inorganic dispersion medium solution under nitrogen gas flow, and stirring thereof with 12,000 RPM during 15 minutes at 60° C. using TK type homomixer (Mark II, made by Primix).

From the result of measuring the prepared first toner particles in micron state after performing the polymerization process of the embodiment 1, average grain diameter (D50) is 1.6 μm, and a degree of rounding is 0.978.

In preparing same as the embodiment 1 except the process, toner particles 2 of which average grain diameter (D50) is 7.6 μm, and a degree of rounding is 0.971 is obtained.

Addition Process

Black toner 2 having good fluidity is obtained by mixing hydrophobic silica (R972, made by Degu) 1 part with 100 part of the toner particles 2 using multipurpose small mixing grinder (made by Mitsui mine).

The result of measuring black toner 2 is shown in [table 3].

Embodiment 3

In the inorganic dispersion medium preparing process, the polymerizable monomer mixture dispersion and solution process, the droplet preparing process, the polymerization process, the aggregation process, the fusing process, the cleaning and drying process, and the addition process of the embodiment 1, black toner 3 is prepared as the embodiment 1 except the aggregation process, the fusing process, the addition process modified as the following.

Aggregation Process

After maintaining the first suspension toner particles in micron state prepared in the embodiment 1 at 30° C., the aggregation process carried out by adding 5 part of aluminum sulfate solution of 0.5% by weight into thereof slowly through 5 minutes until average grain diameter (D50) of final toner particles reaches to 7.0 μm.

Fusing Process

After the aggregation process, the prepared first toner particles in micron state are heated at 70° C. through 1 hour. Then, with maintaining the temperature at 70° C., stirring carries out with 150 RPM during 3 hours.

In preparing same as the embodiment 1 except the process, toner particles 3 of which average grain diameter (D50) is 8.0 μm, and a degree of rounding is 0.942 is obtained.

Addition Process

Black toner 3 having good fluidity is obtained by mixing hydrophobic silica (R972, made by Degu) 1 part with 100 part of the toner particles 3 using multipurpose small mixing grinder (made by Mitsui mine).

The result of measuring black toner 3 is shown in [table 3].

Embodiment 4

In the inorganic dispersion medium preparing process, the polymerizable monomer mixture dispersion and solution process, the droplet preparing process, the polymerization process, the aggregation process, the fusing process, the cleaning and drying process, and the addition process of the embodiment 1, black toner 4 is prepared as the embodiment 1 except the aggregation process, the fusing process, and the addition process modified as the following.

Aggregation Process

After maintaining the first suspension toner particles in micron state prepared in the embodiment 1 at 60° C., the aggregation process carried out by adding 8 part of ferrous sulfate of 0.5% by weight into thereof slowly through 5 minutes until average grain diameter (D50) of final toner particles reaches to 7.0 μm.

Fusing Process

After the aggregation process, the prepared first toner particles in micron state are heated at 80° C. through 1 hour. Then, with maintaining the temperature at 80° C., stirring carries out with 250 RPM during 3 hours.

In preparing same as the embodiment 1 except the process, toner particles 4 of which average grain diameter (D50) is 7.6 μm, and a degree of rounding is 0.975 is obtained.

Addition Process

Black toner 4 having good fluidity is obtained by mixing hydrophobic silica (R972, made by Degu) 1 part with 100 part of the toner particles 4 using multipurpose small mixing grinder (made by Mitsui mine).

The result of measuring black toner 4 is shown in [table 3].

Embodiment 5

In the inorganic dispersion medium preparing process, the polymerizable monomer mixture dispersion and solution process, the droplet preparing process, the polymerization process, the aggregation process, the fusing process, the cleaning and drying process, and the addition process of the embodiment 1, black toner 5 is prepared as the embodiment 1 except the polymerizable monomer mixture dispersion and solution process, the aggregation process, the fusing process modified as the following.

Polymerizable Monomer Mixture Dispersion and Solution Process

| | |
|---|---|
| Styrene | 80 part |
| n-buthyl acrylate | 20 part |
| Ester wax (WE-4, made by yuji, Japan) | 10 part |
| Carbon black(first grain diameter 31 nm) | 5 part |

-continued

| | |
|---|---|
| Polar resins (Polyester resins, FC-1283, made by Mitsubishiraion) | 5 part |
| Acrylic acid | 1 part |
| Cross-linker (divinylbenzen, made by Aldrich) | 0.5 part |
| di-tert-buthyl salicylic acid zinc compound (E-84, made by Orientchemical) | 1 part |

After dispersing the abovementioned components during 5 hours using Attritor (PE-075, made by Netzsch), a polymerizable monomer compounds is prepared by heating thereof at 60° C. A polymerizable monomer compounds is prepared by solving 4 part of 2,2'-azobis(2,4-dimethylvaleronitril) as a polymerization starter in the styrene with maintaining 60° C., and then adding thereof to the polymerizable monomer compounds.

From the result of preparing the first suspension toner particles in micron state after performing the polymerization process of the embodiment 1, average grain diameter (D50) is 2.1 μm, and a degree of rounding is 0.973.

Aggregation Process

After maintaining the prepared first suspension toner particles dispersion solution in micron state at 60° C., the aggregation process carried out by adding 5 part of aluminum sulfate solution of 0.5% by weight into thereof slowly through 5 minutes until average grain diameter (D50) of final toner particles reaches to 7.0 μm.

Fusing Process

After the aggregation process, the prepared first toner particles in micron state are heated at 90° C. through 1 hour. Then, with maintaining the temperature at 90° C., stirring carries out with 150 RPM during 2 hours.

In preparing same as the embodiment 1 except the process, toner particles 5 of which average grain diameter (D50) is 8.2 μm, and a degree of rounding is 0.970 is obtained.

Addition Process

Black toner 5 having good fluidity is obtained by mixing hydrophobic silica (R972, made by Degu) 1 part with 100 part of the toner particles 5 using multipurpose small mixing grinder (made by Mitsui mine).

The result of measuring black toner 5 is shown in [table 3].

Compared Example 1

Inorganic Dispersion Medium Preparing Process

| | |
|---|---|
| Ion-exchanged water | 900 part |
| $Na_3PO_4$ | 3.4 part |
| $CaCl_2$ | 3 .8 part |

In the condition of heating the abovementioned components to 60° C., aqueous dispersion medium containing hydroxyapatite (generation theoretical quantity: 1.5 part by weight) which is insoluble minute particular dispersion stabilizer is obtained by stirring the abovementioned components with 10,000 RPM using TK type homomixer Mark III (made by Primix).

Polymerizable Monomer Mixture Dispersion and Solution Process

| | |
|---|---|
| Styrene | 80 part |
| n-buthyl acrylate | 20 part |
| Paraffin wax (fusing point 72° C.) | 10 part |

-continued

| | |
|---|---|
| Carbon black (first grain diameter 31 nm) | 5 part |
| Polar resins (Polyester resins, ET-2900, made by SK Chemical) | 5 part |
| Methacrylic acid | 1 part |
| Cross-linker (divinylbenzen) | 0.5 part |
| di-tert-buthyl salicylic acid aluminum compound (E-108, made by Orientchemical) | 1 part |

After dispersing the abovementioned components during 5 hours using Attritor (PE-075, made by Netzsch), a polymerizable monomer compounds is prepared by heating thereof at 60° C. A polymerizable monomer compounds is prepared by solving 4 part of 2,2'-azobis(2,4-dimethylvaleronitril) as a polymerization starter in the styrene with maintaining 60° C., and then adding thereof to the polymerizable monomer compounds.

Droplet Preparing Process

A polymerizable monomer mixture in dripped state is prepared by putting the abovementioned polymerizable monomer compounds into the inorganic dispersion medium solution under nitrogen gas flow, and stirring thereof with 6,000 RPM during 10 minutes at 60° C. using TK type homomixer.

Polymerization Process

Toner particles are prepared by stirring the polymerizable monomer mixture in dripped state not to sink or float after changing into Teflon stirring blade, and simultaneously carrying out polymerization during 8 hours at 70° C.

Cleaning and Drying Process

Decompression filtering carried out by cooling slurry obtained after the abovementioned fusing process, adding 5 N hydrochloric acid for pH to maintain below 2, thereby for the inorganic dispersion medium to be solved.

Then, after enough cleaning thereof many times using ion exchanged water 500 part, compared toner particles 1 are obtained by drying thereof at 45° C. decompression dryer during 24 hours.

From the result of measuring the prepared toner particles using Flow type particular analysis device FPIA-3000(made by Sysmax), average grain diameter (D50) is 6.5 μm, and a degree of rounding is 0.961.

Figure 3:
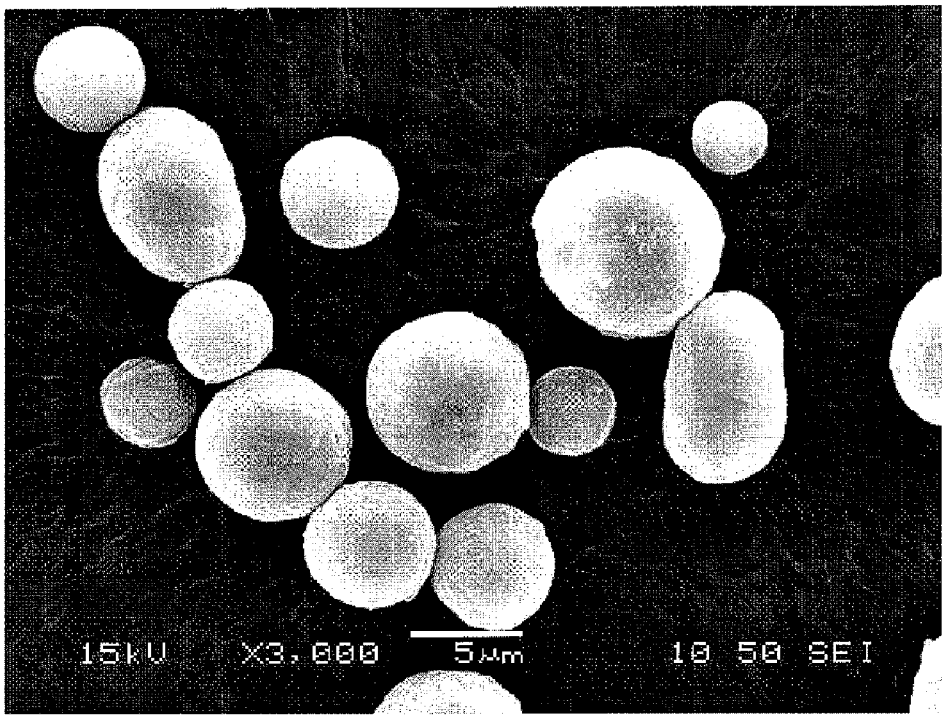
FIG. 3 shows SEM photography of toner particles prepared by the compared example 1 of the present invention.

Photography that the obtained compared toner particles 1 are observed by Scanning Electron Microscope (SEM, made by Jeol) is shown in FIG. 3.

Addition Process

Black compared toner 1 having good fluidity is obtained by mixing hydrophobic silica 1 part with 100 part of the compared toner particles 1 using multipurpose small mixing grinder (made by Mitsui mine).

The result of measuring black compared toner 1 is shown in [table 3].

Compared Example 2

In the inorganic dispersion medium preparing process, the polymerizable monomer mixture dispersion and solution process, the droplet preparing process, the polymerization process, the aggregation process, the fusing process, the cleaning and drying process, and the addition process of the embodiment 1, black compared toner 2 is prepared as the embodiment 1 except the aggregation process, the fusing process, the addition process modified as the following.

Aggregation Process

After maintaining the first suspension toner particles in micron state prepared in the embodiment 1 at 60° C., from the result of carrying out the aggregation process by adding 5 part of aluminum sulfate of 0.5% by weight into thereof through 1 minutes, average grain diameter (D50) of final toner particles reaches to 18.9 μm and the distribution of the grain size is wide.

Fusing Process

After the aggregation process, the prepared first toner particles in micron state are heated at 80° C. through 1 hour. Then, with maintaining the temperature at 80° C., stirring carries out with 150 RPM during 2 hours.

In preparing same as the embodiment 1 except the process, compared toner particles 2 of which average grain diameter (D50) is 20.2 μm, and a degree of rounding is 0.958 is obtained.

Addition Process

Black compared toner 2 having good fluidity is obtained by mixing hydrophobic silica (R972, made by Degu) 1 part with 100 part of the compared toner particles 2 using multipurpose small mixing grinder (made by Mitsui mine).

The result of measuring black compared toner 2 is shown in [table 3].

Compared Example 3

In the inorganic dispersion medium preparing process, the polymerizable monomer mixture dispersion and solution process, the droplet preparing process, the polymerization process, the aggregation process, the fusing process, the cleaning and drying process, and the addition process of the embodiment 1, black compared toner 3 is prepared as the embodiment 1 except the aggregation process, the fusing process, and the addition process modified as the following.

Aggregation Process

After maintaining the first suspension toner particles in micron state prepared in the embodiment 1 at 60° C., from the result of carrying out during 10 hours the aggregation process by adding 0.5 part of aluminum sulfate solution of 0.5% by weight into thereof slowly through 5 minutes, average grain diameter (D50) of final toner particles reaches to 3.3 μm.

Fusing Process

After the aggregation process, the prepared first toner particles in micron state are heated at 80° C. through 1 hour. Then, with maintaining the temperature at 80° C., stirring carries out with 250 RPM during 3 hours.

In preparing same as the embodiment 1 except the process, compared toner particles 3 of which average grain diameter (D50) is 3.5 μm, and a degree of rounding is 0.969 is obtained.

Addition Process

Black compared toner 3 having good fluidity is obtained by mixing hydrophobic silica (R972, made by Degu) 1 part with 100 part of the compared toner particles 3 using multipurpose small mixing grinder (made by Mitsui mine).

The result of measuring black compared toner 3 is shown in [table 3].

Meanwhile, [Table 1] represents conditions of the inorganic dispersion medium process, polymerizable monomer mixture process, polymerization process in preparing the first suspension toner particles in micron state of the embodiments and compared examples, and [Table 2] represents conditions of the aggregation process and the fusing process in preparing the final toner particles of the embodiments and compared examples.

TABLE 1

| No. | Inorganic dispersion medium solution kind | Quantity (g) | Polymerizable monomer mixture Wax | Polar resins | Polar monomer | Charge control agent | Polymerization process Polymerization temperature (° C.) | Polymerization time (HR) |
|---|---|---|---|---|---|---|---|---|
| Embodiment 1 | Hydroxyapatite | 7.1 | Paraffin wax | ET-2900 | Methacrylic acid | E-84 | 70 | 5 |
| Embodiment 2 | Hydroxyapatite | 14.2 | Paraffin wax | ET-2900 | Methacrylic acid | E-84 | 70 | 5 |
| Embodiment 3 | Hydroxyapatite | 7.1 | Paraffin wax | ET-2900 | Methacrylic acid | E-84 | 70 | 5 |
| Embodiment 4 | Hydroxyapatite | 7.1 | Paraffin wax | ET-2900 | Methacrylic acid | E-84 | 70 | 5 |
| Embodiment 5 | Hydroxyapatite | 7.1 | Paraffin wax | ET-1283 | Acrylic acid | E-108 | 70 | 5 |
| Compared Example 1 | Hydroxyapatite | 1.5 | Paraffin wax | ET-2900 | Methacrylic acid | E-84 | 70 | 8 |
| Compared Example 2 | Hydroxyapatite | 7.1 | Paraffin wax | ET-2900 | Methacrylic acid | E-84 | 70 | 5 |
| Compared Example 3 | Hydroxyapatite | 7.1 | Paraffin wax | ET-2900 | Methacrylic acid | E-84 | 70 | 5 |

TABLE 2

| No. | Aggregation process Aggregating agent | Aggregating temperature (° C.) | Fusing process Fusing temperature (° C.) | Stirring RPM |
|---|---|---|---|---|
| Embodiment 1 | Aluminum sulfate | 60 | 80 | 150 |
| Embodiment 2 | Aluminum sulfate | 60 | 80 | 150 |
| Embodiment 3 | Aluminum sulfate | 30 | 70 | 150 |
| Embodiment 4 | Ferrous sulfate | 60 | 80 | 250 |
| Embodiment 5 | Aluminum sulfate | 60 | 90 | 150 |
| Compared Example 1 | — | — | — | — |
| Compared Example 2 | Aluminum sulfate | 60 | 80 | 150 |
| Compared Example 3 | Aluminum sulfate | 60 | 80 | 250 |

The invention claimed is:

1. A method for preparing toner composition having monomers for forming a binder resin, colorings, dispersion stabilizers, charge control agents, wax, polar resins or polar monomers, wherein the method comprises:

(1) preparing an inorganic dispersion medium to obtain a first liquid;

(2) dispersing and dissolving a polymerizable monomer mixture to obtain a second liquid;

(3) micronizing the second liquid obtained in step (2) in the first liquid obtained in step (1) with high shear force in order to create droplets;

(4) forming first suspension toner particles by performing radical polymerization of the micronized droplets obtained in step (3);

(5) aggregating particles obtained in step (4) in the presence of an aggregation agent;

(6) fusing the aggregated particles obtained in step (5) by heat;

(7) forming final toner particles by cleaning and drying the fused particles obtained by step (6); and (8) adding additives to impart electrification and fluidity to the final toner particles obtained by step (7),

TABLE 3

| No. | First suspension toner particles in micron state Average grain diameter (μm) (D50) (A) | Degree of rounding | Final toner particles Average grain diameter (μm) (D50) (B) | Degree of rounding D | Distribution of grain size | A/B |
|---|---|---|---|---|---|---|
| Embodiment 1 | 2.2 | 0.975 | 7.8 | 0.978 | 1.8 | 0.28 D |
| Embodiment 2 | 1.6 | 0.978 | 7.6 | 0.971 | 2.1 | 0.21 D |
| Embodiment 3 | 2.2 | 0.975 | 8.0 | 0.942 | 2.0 | 0.28 D |
| Embodiment 4 | 2.2 | 0.975 | 7.6 | 0.975 | 1.9 | 0.29 D |
| Embodiment 5 | 2.1 | 0.973 | 8.2 | 0.970 | 2.2 | 0.26 D |
| Compared Example 1 | — | — | 6.5 | 0.961 | 3.5 | — |
| Compared Example 2 | 2.2 | 0.975 | 20.2 | 0.958 | 14.3 | 0.11 D |
| Compared Example 3 | 2.2 | 0.975 | 3.5 | 0.968 | 1.9 | 0.63 D |

wherein a grain diameter (D50(A)) of the first suspension toner particles and a grain diameter (D50(B)) of the final toner particles meet the following equation 1:

[EQUATION 1]

$$0.2 \leq A/B \leq 0.5 \quad (1)$$

$$4\ \mu m \leq B \leq 10\ \mu m \quad (2)$$

wherein, A is a grain diameter (D50(A)) of the first suspension toner particles; and B is a grain diameter (D50 (B)) of the final toner particles.

2. The method for preparing toner composition according to claim 1, wherein the inorganic dispersion medium in preparing an inorganic dispersion medium is at least one inorganic dispersion medium salts containing both calcium and phosphate.

3. The method for preparing toner composition according to claim 2, wherein an amount of the inorganic dispersion medium is 1.5% to 30% by weight with respect to the polymerizable monomer mixture.

4. The method for preparing toner composition according to claim 1, wherein the wax is at least one wax selected from the group consisting of paraffin-based wax, ester-based wax, micro crystal wax, montan-based wax, Fischer-Tropsch wax, polyethylene wax, polypropylene wax, and carnauba wax.

5. The method for preparing toner composition according to claim 4, wherein an amount of the wax is 0.5 part to 30 part by weight for 100 part by weight of the polymerizable monomer.

6. The method for preparing toner composition according to claim 4, wherein DSC maximum heat absorption peak of the wax is 40° C. to 110° C.

7. The method for preparing toner composition according to claim 1, wherein the polar resin is at least one polar resin selected from the group consisting of polyester resin and polystyrene copolymer resin.

8. The method for preparing toner composition according to claim 1, wherein the polar monomer is at least one polar monomer selected from the group consisting of acrylic acid, methacrylic acid, itaconic acid, maleic acid, and fumaric acid.

9. The method for preparing toner composition according to claim 1, wherein the charge control agent is at least one charge control agent selected from the group consisting of dibutyl salicylic acid, naphthoeic acid, dicarboxylic acid, dibutyl salicylic acid aluminum compound, dibutyl salicylic acid zinc compound, dibutyl salicylic acid zirconium compound, dibutyl salicylic acid chrome compound, nigrosine-based compound, quaternary ammonium salt, and imidazole compound.

10. The method for preparing toner composition according to claim 9, wherein an amount of the charge control agent is 0.5 part to 10 part by weight for 100 part by weight of the polymerizable monomer.

11. The method for preparing toner composition according to claim 1, wherein the aggregation agent for step (5) is at least one aggregation agent selected from the group consisting of an inorganic salts having monovalent metallic cations, an inorganic salts having divalent metallic cations, and an inorganic salts having trivalent metallic cations.

12. The method for preparing toner composition according to claim 11, wherein the inorganic salt having monovalent metallic cations is at least one inorganic salt selected from the group consisting of NaCl, KCl, LiCl, $Na_2SO_4$, $K_2SO_4$, $Li_2SO_4$, $CH_3COONa$, and $C_6H_5SO_3Na$, the inorganic salt having divalent metallic cations is at least one inorganic salt selected from the group consisting of $MgCl_2$, $CaCl_2$, $MgSO_4$, $CaSO_4$, and $ZnSO_4$, the inorganic salt having trivalent metallic cations is at least one inorganic salt selected from the group consisting of $Al_2(SO_4)_3$ and $Fe_2(SO_4)_3$.

13. The method for preparing toner composition according to claim 1, wherein the aggregation temperature in aggregating is 5° C. to 80° C.

14. The method for preparing toner composition according to claim 1, wherein a degree of rounding of the first suspension toner particles in micron is 0.92 to 0.99.

15. The method for preparing toner composition according to claim 14, wherein the degree of rounding of the final toner particles is 0.9 to 0.99.

* * * * *